US006675702B1

(12) United States Patent
Maksimow

(10) Patent No.: US 6,675,702 B1
(45) Date of Patent: Jan. 13, 2004

(54) METHOD AND DEVICE FOR PRODUCING A STRIP OF CELLULOSE FIBER MATERIAL FOR USE IN HYGIENE ARTICLES

(76) Inventor: Alexander Maksimow, Hangenkamp 25, D-48565 Steinfurt-Borghorst (DE)

( * ) Notice: Subject to any disclaimer, the term of this patent is extended or adjusted under 35 U.S.C. 154(b) by 0 days.

(21) Appl. No.: 09/554,636

(22) PCT Filed: Nov. 16, 1998

(86) PCT No.: PCT/EP98/07305

§ 371 (c)(1),
(2), (4) Date: Jul. 13, 2000

(87) PCT Pub. No.: WO99/25281

PCT Pub. Date: May 27, 1999

(51) Int. Cl.[7] ..... B30B 11/28
(52) U.S. Cl. ..... 100/41; 100/161; 100/176
(58) Field of Search ..... 100/161, 35, 327, 100/334, 155 K, 157, 162 R, 163 R, 176, 41; 428/198, 171

(56) References Cited

U.S. PATENT DOCUMENTS 3,692,622 A * 9/1972 Dunning ..... 428/171
3,726,750 A * 4/1973 Stillings ..... 428/198
4,111,744 A * 9/1978 Reiniger ..... 162/100
5,128,193 A * 7/1992 Anapol et al. ..... 428/171
5,532,065 A * 7/1996 Gubitz et al. ..... 428/480
5,587,225 A * 12/1996 Griesbach et al. ..... 428/198
5,652,041 A * 7/1997 Buerger et al. ..... 428/198
6,200,424 B1 * 3/2001 Saari et al. ..... 162/205

FOREIGN PATENT DOCUMENTS

WO WO9410956 5/1994

OTHER PUBLICATIONS

"The Technology of the Future In Air Forming Systems" Dan–Webforming International A/S., Risskov, Denmark. Dan–Web Pilot Plant Facilities Research and Development.

* cited by examiner

*Primary Examiner*—Allen Ostrager
*Assistant Examiner*—Shelley Self
(74) *Attorney, Agent, or Firm*—Milde & Hoffberg, LLP

(57) ABSTRACT

The invention relates to a method for producing a strip of absorbent, rollable cellulose fiber material (100) which is suitable for use in the hygiene sector. A fiber layer consisting of cellulose fibers is placed on a base layer (8) and pre-compressed to form a loose non-woven fabric which is introduced into a gap between a pair of calendar rollers (6.1, 6.2) and which is used to produce a pattern of dotted or lined pint areas (17) in which the fibers (1) are disposed in a random manner and are compressed against each other at a pressure ranging from 150 to 600 MPa, resulting in a non-solvent fusion of said fibers and the production of a strip of fiber material (100) with an imprinted pattern.

24 Claims, 7 Drawing Sheets

METHOD AND DEVICE FOR PRODUCING A STRIP OF CELLULOSE FIBER MATERIAL FOR USE IN HYGIENE ARTICLES

BACKGROUND OF THE INVENTION

The invention relates to a method of claim 1 and a device for producing a fiber web consisting of cellulose fibers for use in hygiene products, in particular, personal, absorbing hygiene products. The invention further relates to an absorbent fiber web manufactured according to this method.

It is known to combine cellulose-containing material such as wood or plant fibers into a fiber web by employing a combination of mechanical and chemical processing steps under intensive heating while excluding oxygen. The aim of such a process is to avoid the use of binding agent additives either completely or to a large extent. According to one of these known methods, disclosed in U.S. Pat. No. 4,111,744, cellulose fibers with a moisture content of 3 to 12 percent by weight are subjected to pressure in an oxygen-free atmosphere at a temperature of 450 to 800° F. (=232 to 426° C.), which is a high temperature environment beyond the cellulose carbonizing temperature and cellulose combustibility temperature. Paper-type products may also be manufactured using the aforementioned known method, but, only that of stiff cardboard.

The disadvantage of this method is that a considerable technological effort needs to be invested to heat the pressurized space and to prevent combustion of the material through oxygen-free manufacturing.

Also known from the International Patent Publication No. WO 94/10956 is a method for producing under pressure absorbent web products from dry cellulose fibers and additives by compressing a material with a weight per unit area of 30–2000 g/cm$^2$ to a product with a density of 0.2–1.0 g/cm$^3$. Compressing is carried out using smooth calender rollers. The disadvantage of this method is that although the density is increased, the tear strength of the material itself is low. Synthetic additives, especially theromplasts, must be added to increase the tear strength.

It is further known from the U.S. Pat. No. 3,692,622 to initially form an irregular cellulose fiber layer and under relatively low pressure to produce a loose non-woven fabric with a low density and tear strength. The loose non-woven is then entered into the gap of an additional pair of calender rolls and embossed with a pattern of point- or line-shaped pressure zones. The result is a soft, absorbent web material with a base weight of about 16.9 to 50.9 g/m$^2$. The tear strength of this fiber web is about 0.09 kN/m. Thus, it is a material that tears easily as is the case with facial tissues, for example. The calender pressures applied for this known product are about 2,000 to 10,000 psi corresponding to 14 to 69 MPa. The US-A document speaks of resultant hydrogen bonding, as is also the result in self-bonding conventional paper products.

The fiber web manufactured by the method is said to be particularly suitable for manufacturing hygiene products. It is said to be very absorbing, soft and capable for processing as a web. Single-use hygiene articles such as diaper panties and such are manufactured in high volume. The core absorbing layers used for these products should be tolerated well by the body, the absorbed liquids well distributed, and after use, the products should rot in landfills without residue. A known method is to manufacture the absorbing layer of a wood cellulose fiber matrix, where so-called superabsorbers can be added to this fiber matrix to increase the liquid absorption capacity. Superabsorbers are polymers that can absorb water by building hydrogels.

SUMMARY OF THE INVENTION

It is a principal object of the present invention to specify a method for producing a fiber web made of cellulose fibers, where essentially no binding agents need to be used, and were the process can be carried out at room temperatures under normal atmospheric pressure and with the oxygen content of ambient air.

This object, as well as other objects which will become apparent from the discussion that follows, are accomplished with the method for manufacturing a fiber web made of cellulose fibers, which is largely tear resistant, absorbent and rollable, using the following processing steps (a) placing an irregular cellulose fiber layer and pre-condensing it under relatively low pressure to produce a loose non-woven with low density and tear strength; and (b) inserting the loose non-woven into the gap of a pair of calender rolls that is used to create a pattern of point- or line-shaped pressure zones under relatively high pressure, where the irregularly arranged fibers are pressed onto each other, wherein (1) the moisture content of the loose non-woven is up to 5 percent by weight when it is inserted, (2) the irregularly arranged fibers are pressed onto each other in a second pair of calender rolls under a pressure in a range between 250 and 600 MPa such that a non-separating fusion of the fibers occurs and a fiber web with an embossing pattern is created, and (3) the tear strength of the fiber web is at least 0.12 kN/m.

It is assumed that in the technology of producing cellulose fibers it is known to make them of a wood derivative known in the industry as "fluff pulp". This material is a standardized wood product made of cellulose material shipped in boards or webs, so-called wood pulp cardboards, where said material is crushed in a hammer mill and separated into fibers until it turns into a cotton-like product of cellulose fibers, namely fluff pulp. A description of such a standardized crushing process can be found, for example, in the brochure of the company Dan-Webforming International A/S. Risskov, Denmark.

This wood derivative called "fluff pulp" is a product that is used in large quantities in the so-called water-less paper production. Preferably, the fibers have a length of about 1 to 5 mm as they exit the hammer mill. According to the first step of the aforementioned process, they are embedded irregularly in a cellulose fiber layer with a height of 5 to 15 mm and are preferably sent on a conveyor belt to a movable strainer through a pre-condenser station that consists preferably of a pair of calender rolls with low pressure, such that the result is a loose non-woven with low density and tear strength. The tear strength is dimensioned such that the non-woven can sag over a length of 0.1 to 1 m without tearing. It can also withstand air pressures that occur during the production.

This essentially known and still very loose non-woven is inserted into a gap of a pair of calender rolls, where a significant pressure is applied in the point-shaped pressure zones. The pressure must be at least 100 and should be about 520 MPa (MPa=N/mm$^2$). The liquid limit of the material used for the rollers is generally the upper pressure limit. According to the state-of-the-art, such high pressures have not been used until now. To produce such a pressure, rollers may be used with studs, with line patterns offset from one another or with other protruding point- or line-shaped pressure surfaces, where the array density of the point-shaped pressure zones is between 1 and 16 array points per $cm^2$.

A fiber web, preferably with a $m^2$ weight between 50 g and 1500 g, is produced according to the method. Due to the distribution of the connecting points, this new fiber web has become so strong that a tear strength of at least 0.12 kN/m, preferably of up to 0.65 kN/m, is achieved. The thickness of the fiber web is dependent on the desired metrage.

The size of the pressure area of the point-shaped pressure zones is dependent on the pressure that can be achieved between the second calender rollers. Point-shaped pressure zones with areas between 0.05 and 10 $mm^2$ have proven sufficient.

As has already been emphasized, the temperature of the second pair of calender rolls should be maintained at room temperature, that is, between 19 and 25° C. The operation can also take place at higher temperatures. It should be noted that the temperature will increase in the pressure zones due to the significant use of power.

Pre-compression should take place at a tool temperature of between 18 and 320° C., preferably between 250 and 300° C. Preferably, the pre-compression tool is a pair of calender rolls that can be heated.

The fiber and/or the loose non-woven are brought to a certain moisture content before entering the calender rolls, where preferably the moisture content should be set to between 2 and 9 percent in weight, at a minimum to 1.5 percent in weight.

Starting material is the aforementioned fluff pulp wood derivative. Preferably, this is a standardized defibered product, such as the one also used in manufacturing fiber webs according to known methods. Sulfite or sulfate bleached long fiber cellulose of northern wood appears very advantageous.

It has also proven advantageous, when the cellulose fibers were not bleached to total whiteness but instead when they still contained a certain content on natural wood materials. The degree of whiteness should be between 80 and 92%, preferably between 85 and 89%. A certain remaining lignin content has shown to be advantageous as well, for example if it is between 0.5 and 5 percent in weight of the starting material.

Non-binding, inorganic pigments or fillers, such as titanium oxide, kaolin or zeolithe can be added to the starting material.

A certain amount of superabsorbers can be added to the starting fibers as well, where the acrylate composites known as superabsorbers can be added in powder form to the fluff pulp in an amount of, for example, 0.5 to 70 percent in weight (in relation to the total amount) and where the manufacturing process is not significantly influenced by this.

In the pressure zone of the second calender roll, the radial distance of the calender roll pair beyond the actual point-shaped pressure zones should be about 1 to 15 mm such that the material beyond the pressure zone is not squashed during the pressure application, but is rather fluffed and somewhat compressed.

The gap in the pressure zone of the second pair of calender rolls is dependent on the metrage and the thickness of the inserted loose non-woven. In general, the gap should not exceed a clear width of 0.05 to 1 mm.

A significant part of the device for carrying out the method is formed by the second pair of calender rolls, which is preferably made up of two steel calender rollers both provided with numerous studs distributed across the outer surfaces of the rollers corresponding to point-shaped pressure zones that are surrounded by indentations that exhibit a multiple of the volume of the raised areas. In the operating gap, the raised areas of the two rollers are opposite one another, and a pressure of at least 200 MPa up to the maximum liquid limit of the material used for the studs is exerted on the non-woven located in the point-shaped pressure zones.

The preferable height of the studs or other pressure zones is between 0.5 and 15 mm from the roller base. The studs are preferably shaped as pyramids or truncated cones with a stud coat angle of 10 to 45° in relation to the radius. Line-shaped or similar pressure zones are possible as well.

The irregularly arranged fibers are compressed under very high localized pressure in line or point-shaped pressure zones, such that a multitude of close fusions of the fiber bodies occur that will not separate after the pressure is released. A product of numerous irregular cellulose fibers is produced, where said fibers are connected in the pressure zones through fiber bonding. The fiber web has sufficient tear strength and also a high absorption capacity such that it is ideally suited for hygiene products.

It has shown that in order to meet the specific requirements of the hygiene industry, the web of fiber materials must subsequently be combined with suitable materials in a labor-intensive manner. Thus, the additional objective is given to specify an additional method for producing a fiber web consisting of cellulose fibers that is equipped with, for example, increased tear strength, density or breathing and/or insulating capacities.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
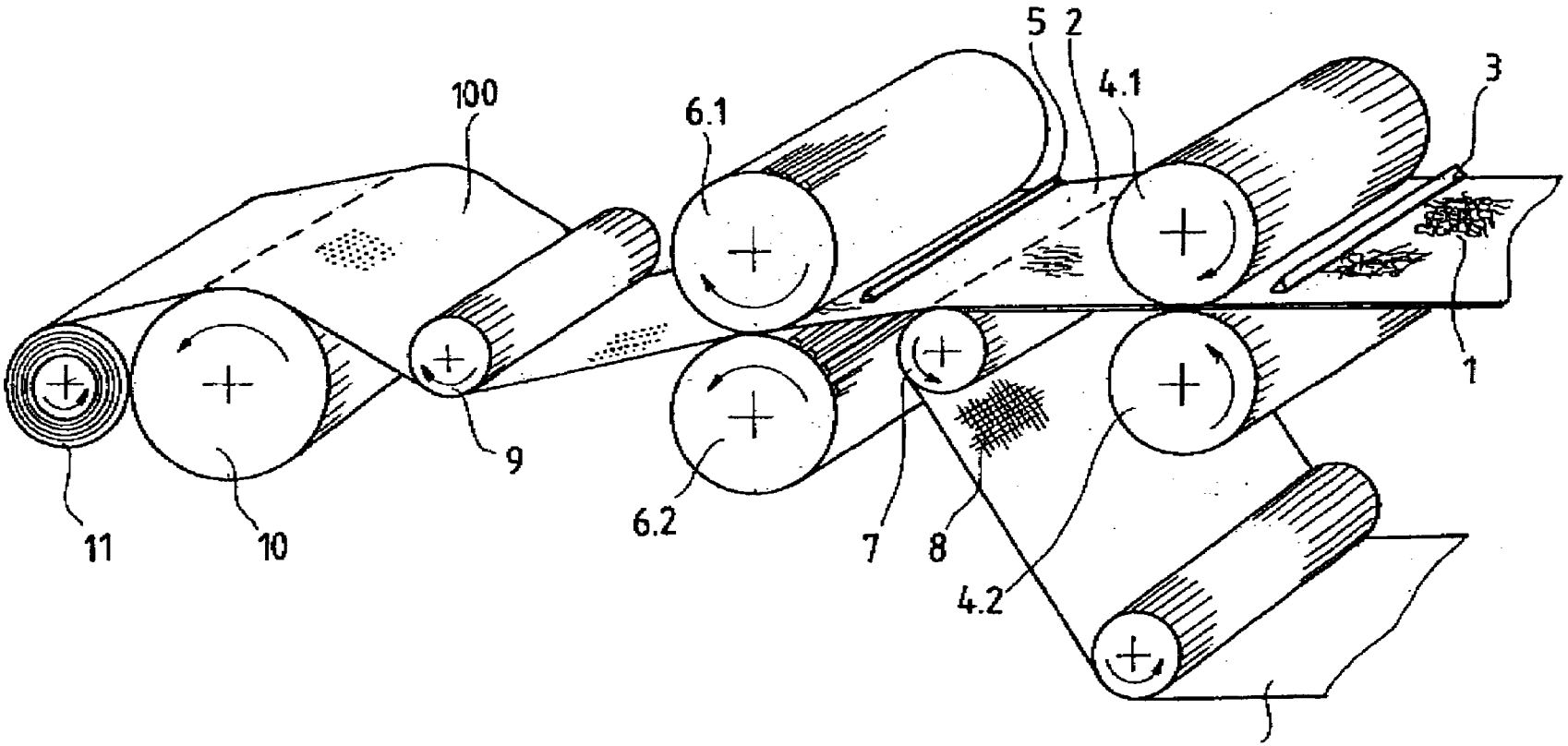
FIG. 1 is a schematic representation of a device for producing a fiber web made of cellulose fibers.

The preferred embodiments of the present invention will now be described with reference to FIGS. 1–7 of the drawings. Identical elements in the various figures are designated with the same reference numerals.

FIG. 1 shows in a schematic sequence an arrangement of rollers and rolls for carrying out the method. The production process starts with cellulose fibers made of fluff pulp, preferably of dry wood pulp cardboards by means of a hammer mill, which is described in great detail in the state-of-the-art presented in the aforementioned brochure of Dan Webforming International A/S.

A layer of irregular fibers 1 in a height of about 20 mm is conveyed to a first pair of calender rollers 4.1, 4.2 on a strainer conveyer belt 8. The upper roller 4.1 has a surface temperature of about 220° C., while the bottom roller is unheated. The web is moisturized by spraying from above using a moisturizing device 3 prior to entering the gap between the two rollers 4.1 and 4.2. The resultant moisture of the material is about 5 to 10 percent in weight.

A portion of the moisture is eliminated between the calender rollers 4.1 and 4.2, and the irregular cellulose fiber layer is compressed to a loose non-woven with low density and tear strength. However, the tear strength is sufficient that the non-woven 2 does not tear when bridging the distance between the end of the strainer belt 8 and the reversing roll 7 to the inlet into the gap between the two additional calender rolls 6.1 and 6.2, which is about 50 cm.

The first processing step is simply a pre-compression or compacting of the non-woven from the irregularly arranged fibers. A fixed web is not produced and it is entirely possible to remove the fibers individually, piece by piece. The tear strength of the non-woven is very low, preferably at least 8 N/m wide.

The non-woven 2 provided by the strainer belt 8 is again moisturized from top and bottom (moisturizing device 5) prior to entering the gap between the two calender rolls 6.1 and 6.2.

Between the calender rolls 6.1 and 6.2, the initially loose non-woven is subjected to an array of point-shaped pressure zones, where the irregularly arranged fibers are pressed onto each other under high pressure, such that a close fusion of the fiber bodies occurs and a fiber web 100 with an embossed pattern is created that will not separate after the pressure is released. The roller arrangement can also be termed as "pixel rollers".

Carbonization of the fiber material is avoided. However, it is obvious that the pressure is sufficiently high to practically melt the materials constituting the fibers, that is, cellulose and remaining lignin and other materials, where such close bonding occurs that goes beyond the bond of simple adhesion. Through point-focused high pressure and crowding of the fibers, the loose cellulose or pulp fibers are bonded together in all existing free spaces, additionally glued and interlocked, resulting in an overall very strong fiber web.

Rolls 6.1 and 6.2 are operated at regular room temperatures, that is, between 18 and 25° C., however it should not be excluded that the rollers may be heated or that a higher temperature may be reached at the point-shaped and also point-focused pressure zones due to the high mechanical energy. The pressure affecting the cellulose fiber layer in the point-shaped pressure zones 17 (cf. FIG. 2) is preferably above 500 MPa, but definitely in a range of 100 to 600 MPa, even higher with a respective technological effort.

With this method, fiber webs with a m weight between 50 and 1500 g, for example, can be produced. The fiber web exiting the calenders is significantly more tear resistant than the web entering the calender rolls 6.1 and 6.2. The material is treated with broad drawing roller 9. Thereafter, it is wrapped onto a take-up roller 11 with the use of a driver roller 10.

Foremost, the material used should be an inexpensive mass material that is available in large amounts. Fluff pulp with a whiteness of 85 to 89% is the preferred choice, which in turn means that a significant lignin and residue content is still present. It has been shown that such residues significantly improve the bonding behavior. Experience shows that cellulose bleached entirely has a worse bonding behavior than less pure cellulose. The titer should not be below a certain length because fibers that are too short cannot bridge the distance between the point-shaped pressure zones such that low tear strength is achieved with low titer.

Supplementary additives are also dimensioned according to the desired tear strength. The addition of so-called superabsorbers, as described in the aforementioned Patent Publication No. WO 94/10596, for example, is relatively uncritical. Fluff pulp can be supplemented with superabsorbers with 0.5 to 70 percent in weight, preferably 5 to 30 percent in weight, and thereafter sent through the high-pressure calender rolls 6.1 and 6.2. The superabsorbers have no bonding effect; too large an amount will reduce the tear strength.

However, the addition of crushed non-bonding inorganic materials, such as the white pigment titanium oxide, reduces the tear strength such that, in general, a percentage of 25 percent in weight of titanium oxide should not be exceeded. A similar rule applies to fillers such as kaolin and zeolithe.

It is important that binding agents such as are known from the state-of-the-art, which are generally required, can be avoided almost entirely. This significantly improves the recycleability and compostability of the product. The production becomes less expensive and is simpler because stations for applying and curing are not required. However, it shall not be precluded that the finished product can be provided with a surface finish or laminated with a film on one or both sides after running through the calender rollers 6.1 and 6.2.

Figure 2:
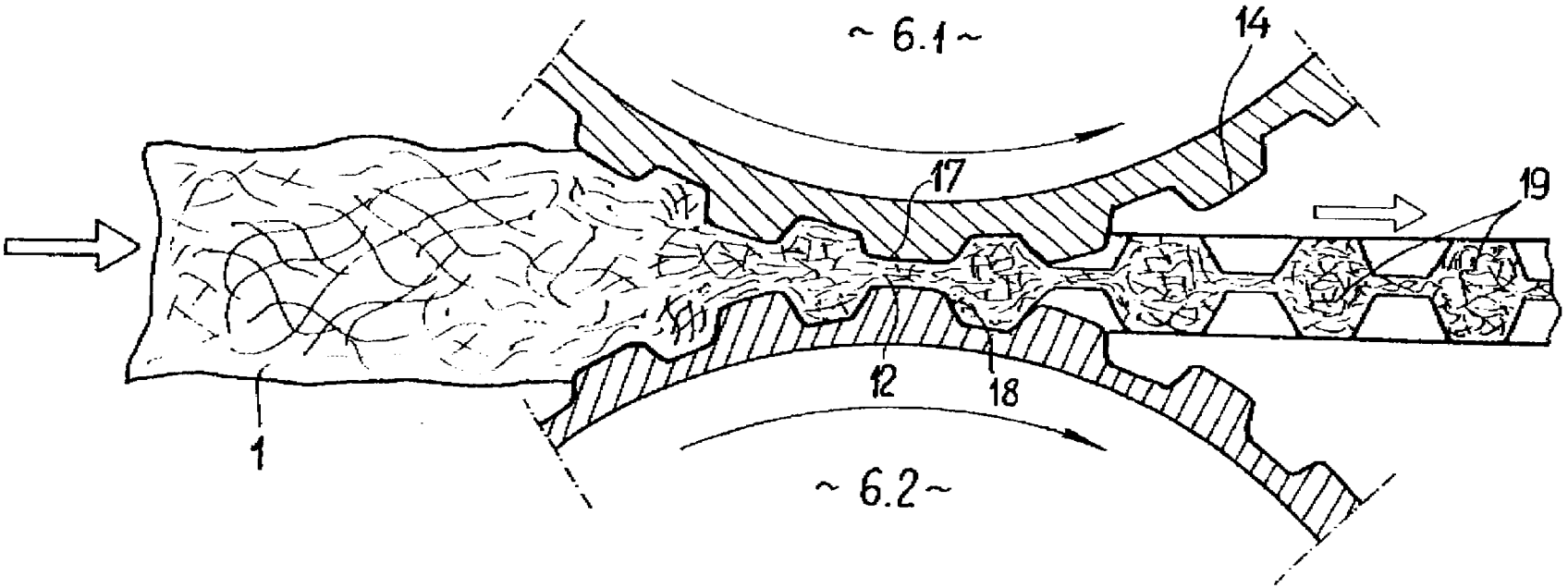
FIG. 2 is an enlarged representation showing the cross-section of the pressure zone of two rollers with pyramid-shaped studs.

FIG. 2 shows an exemplary embodiment of a high pressure zone between the two calender rollers 6.1 and 6.2. As can be seen, the outer roller surface is provided with studs 14, shown in an enlarged presentation. The numerous studs distributed across the entire outer roller surface result, preferably, in an array density of the point-shaped pressure regions of between 1 and 16 array points per $cm^2$ for the finished fiber web. The studs have the shape of a truncated pyramid with a stud coat angle of 10 to 45° in relation to the radius. A calculated pressure of a bout 520 MPa, which leads to the aforementioned fusion of the cellulose fibers in the gap, is present in the gap 12, where the pressure zone 17 is created. Other shapes of the pressure zones, such as truncated cones, cylinders or cubes are possible and are selected according to professional opinions according to the required pressure, the respective starting material and the material of the rollers, the temperatures that occur, etc.

In the present case, the direction of the operation is from left to right. Thus, the finished product exhibits almost lucid fusion zones 18, that alternate with somewhat fluffy loose regions 19 that are, however, compressed when compared to the starting non-woven.

Figure 3:
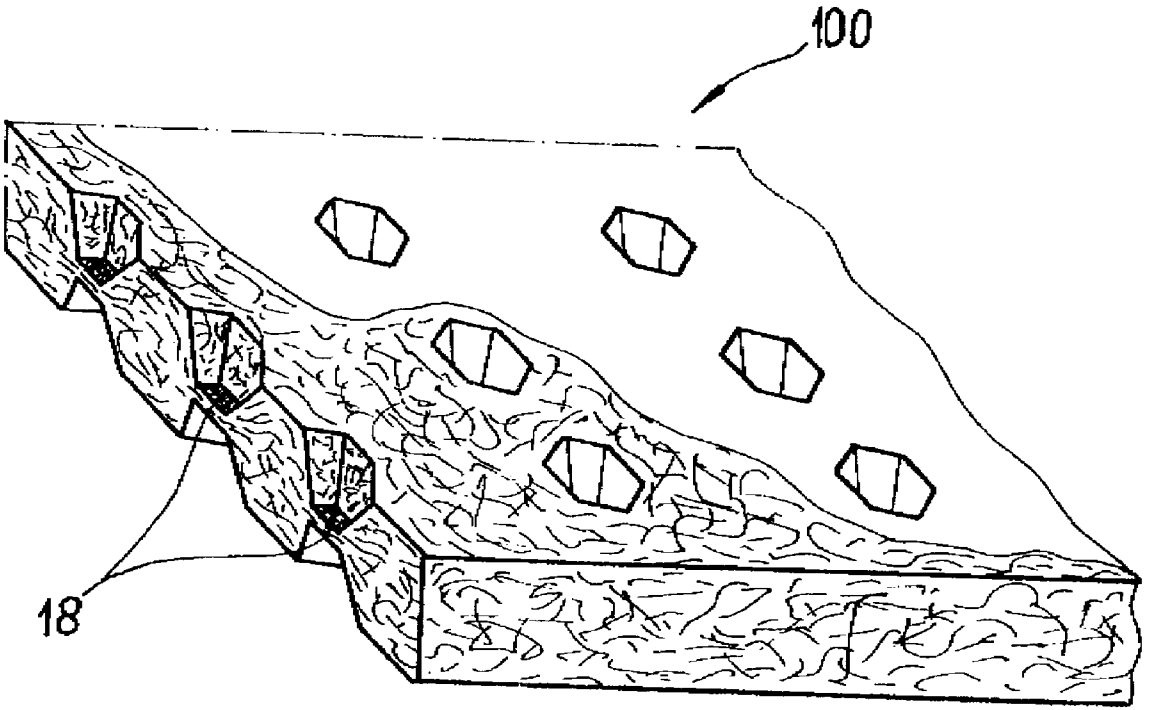
FIG. 3 is a perspective representation of a section of the product manufactured according to the method.

FIG. 3 shows the finished product, consisting of numerous irregular cellulose fibers that are connected by fusion in the pressure zones 18. The material itself has a high tear strength and, in addition, a high absorption capacity, which is increased even further through the use of superabsorbers such that it can be used as packaging material, for hygiene products, lining material, pillow filler and similar products. The material can also be used in the construction industry as a well as replacement for paper and cardboard. The aforementioned products can also be used for napkins, tampons, baby diaper panties, slip inserts, sanitary napkins, and incontinence products.

Figure 4:
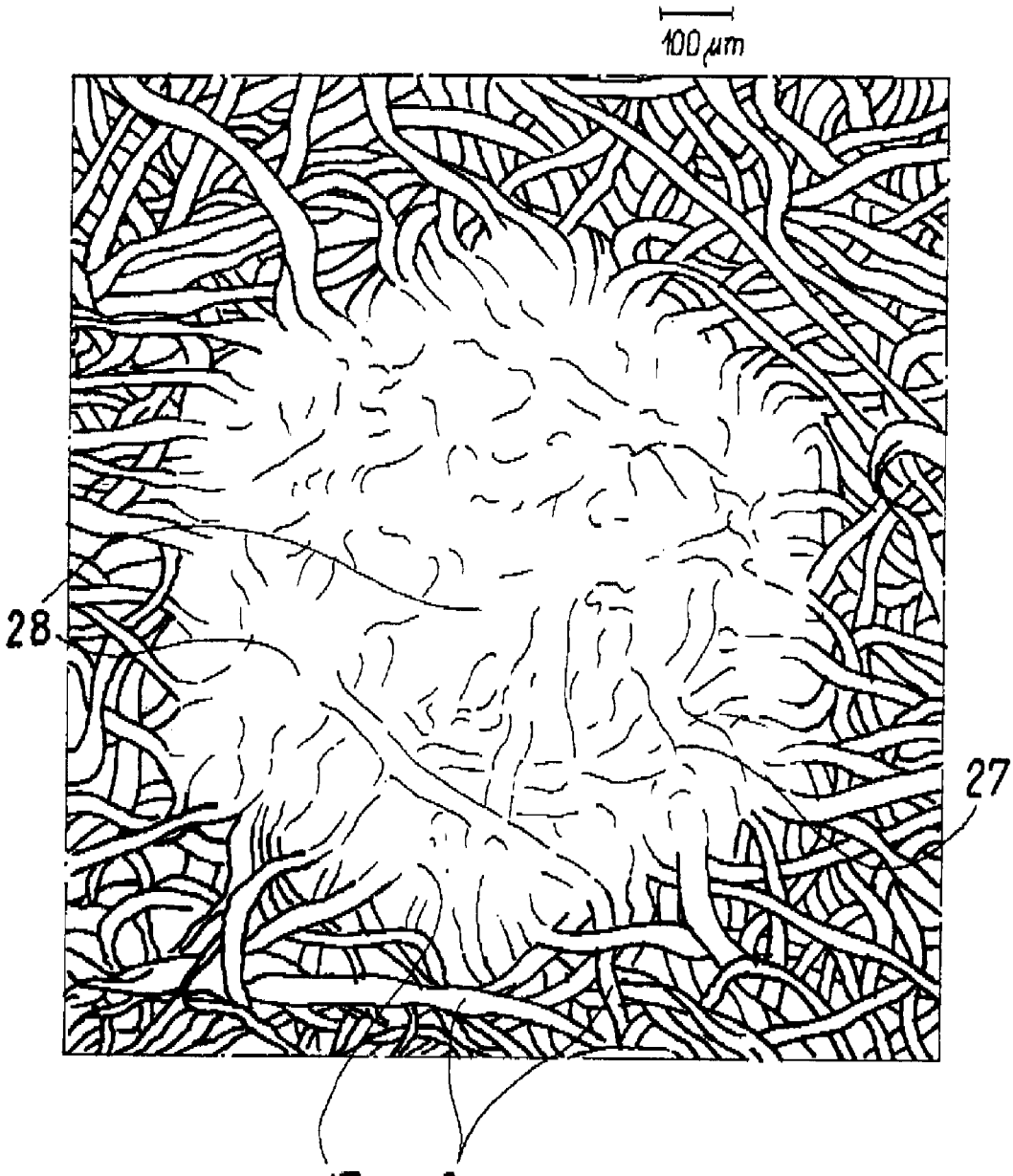
FIG. 4 is an enlarged representation of the pressure zones of the fiber web.

FIG. 4 shows an enlarged presentation of a pressure zone 17 in an electron microscope image. In this case, the pressure zone has a hexagonal shape that has been caused by the insertion of a stud 14 into the non-woven. The pressure applied in this case is 190 MPa (=190 N/mm$^2$). It can be seen that the initially round and undamaged fibers 29 are flat and smooth in the pressure zone due to the pressure. The superabsorber particles that were present are optically no longer recognizable, because they have obviously been pressed into the surface. The fiber structure can still be recognized somewhat in the portion of the zones 27 inside the pressure zone 17, while other zones 28 are present where a fiber structure can no longer be recognized. The fibers pressed onto one another can no longer be separated from one another when trying to do so with a dissecting needle. Thus, a fusion, compacting and gluing with surface bonding of the fiber and/or cellulose substance has occurred with the pressure being kept under the carbonization limit of the fibers 29.

Figure 5:
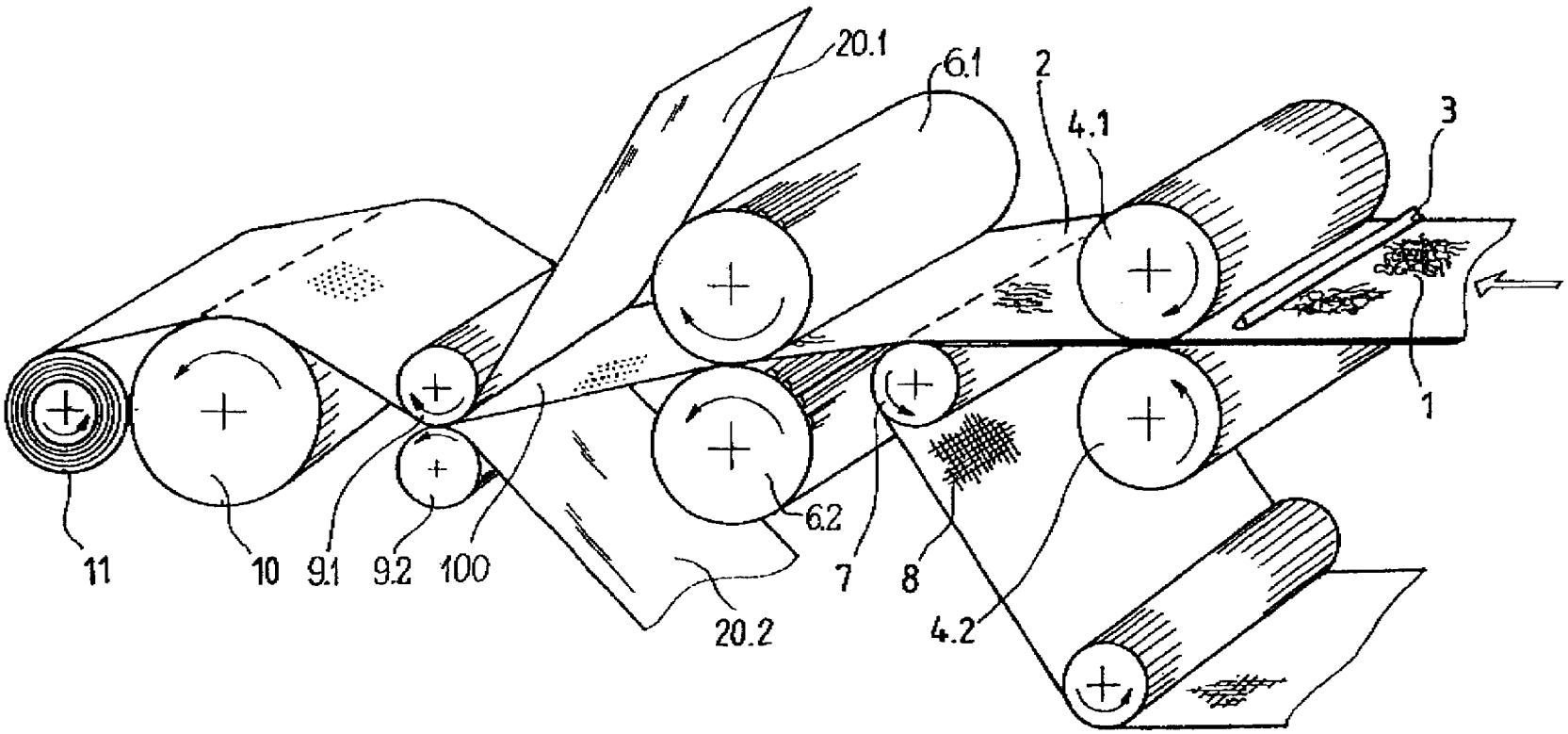
FIG. 5 is a schematic representation of a different device for producing a fiber web with two additional synthetic layers.

FIG. 5 shows a schematic sequence of an arrangement of rollers and rolls where the method is carried out using a second embodiment. A layer of irregular fibers 1 in a height of about 20 mm is conveyed to a first pair of calender rollers 4.1, 4.2 on a strainer conveyer belt 8. The upper roller 4.1 has a surface temperature of about 250° C., while the bottom roller is unheated. The web is moisturized by spraying from above using moisturizing device 3 prior to entering the gap between the two rollers 4.1 and 4.2. The resultant moisture of the material is about 5 to 10 percent in weight.

A portion of the moisture is eliminated between the calender rollers 4.1 and 4.2 and the irregular cellulose fiber layer is compressed to a loose non-woven with low density and tear strength.

Between the calender rolls 6.1 and 6.2, the initially loose non-woven is subjected to an array of point-shaped pressure zones where the irregularly arranged fibers are pressed onto each other under high pressure such that a close fusion of the fiber bodies occurs and a fiber web 100 with an embossed pattern is created that will not separate after the pressure is released.

After passing the calender rollers 6.1 and 6.2, the fiber web 40 is on both sides glued to, welded to and/or mechanically connected to webs 20.1 and 20.2 made of textile, non-woven-type or foil-type material. The prefabricated coating webs 20.1, 20.2 have—as far as necessary—already been coated with adhesive, and are guided from above and below onto the fiber web that exits from the calender roller pair 6.1, 6.2 and fused to it using the pressure roll pair 9.1, 9.2. A mechanical connection of the coating with the fiber material is also possible using pressure rollers 9.1, 9.2 provided with embossing elements. Gluing with a hot adhesive is possible as well. The composite is wrapped onto a take-up roller 11 with the use of a driver roller 10.

Figure 6:
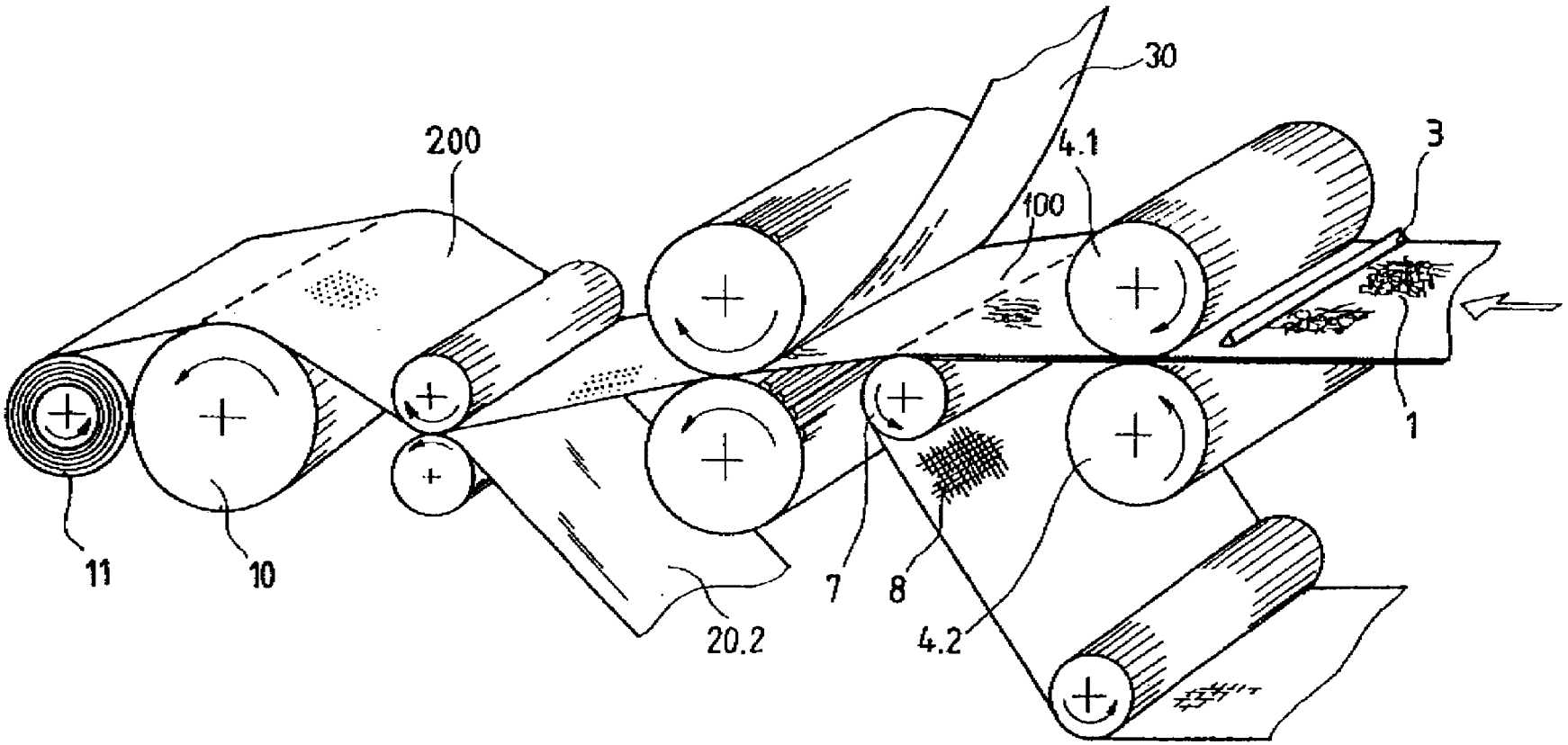
FIG. 6 is a schematic presentation of yet another device for producing a fiber web with a synthetic coating.

FIG. 6 shows in a schematic sequence an arrangement of rollers and rolls for carrying out the method in an additional embodiment. The production process starts with cellulose fibers made of fluff pulp that has been made of dry "wood pulp" using hammer mills.

Similar to FIG. 1, a layer of irregular fibers 1 in a height of about 20 mm is conveyed to a first pair of calender rollers 4.1, 4.2 on a strainer conveyer belt 8. The upper roll 4.1 has a surface temperature of about 180° C., while the bottom roller is unheated.

The irregular cellulose fiber web is compressed between the calender rollers 4.1 and 4.2 to a loose non-woven with low density and tear strength. Prior to entering the gap between the two calender rolls 6.1 and 6.2, the non-woven 2 provided by the strainer belt 8 is covered from the top with a thin (10 $\mu$m) foil 30 made of PTFE that initially is not perforated (PTFE=polyfluorethylen).

Between the calender rolls 6.1 and 6.2, the non-woven covered with the PTFE foil is subjected to an array of point-shaped pressure zones where the irregularly arranged fibers are pressed onto each other under high pressure such that a close fusion of the fiber bodies occurs and a fiber web 100 with an embossed pattern is created that will not separate after the pressure is released; the foil, which is relatively heat-resistant is included in the composite. Carbonization of the fiber or foil material is prevented. The sintering or beginning-to-melt foil material achieves additional bonding.

Rolls 6.1 and 6.2 are operated at regular room temperatures, that is, between 18 and 26° C., however it should not be precluded that the rolls may be heated or that a higher temperature may be reached at the point-shaped and point-focused pressure zones due to the high mechanical energy.

The pressure affecting the cellulose fiber layer with the foil placed on it in the point-shaped pressure zones 17 (cf. FIG. 4) is preferably above 300 to 400 MPa. After passing through the calender rollers 6.1, 6.2, the fiber web is on one side connected with a foil web. The composite is wrapped onto a take-up roller 11 with the use of a driver roller 10.

An additional coating web 20.2 has—as far as necessary—already been coated with adhesive, and is guided from below onto the web that exits from the calender roller pair 6.1, 6.2 and fused to it using the pressure roll pair 9.1, 9.2 (cf. FIG. 6). The composite is wrapped onto a take-up roller 11 with the use of a driver roller 10.

Figure 7:
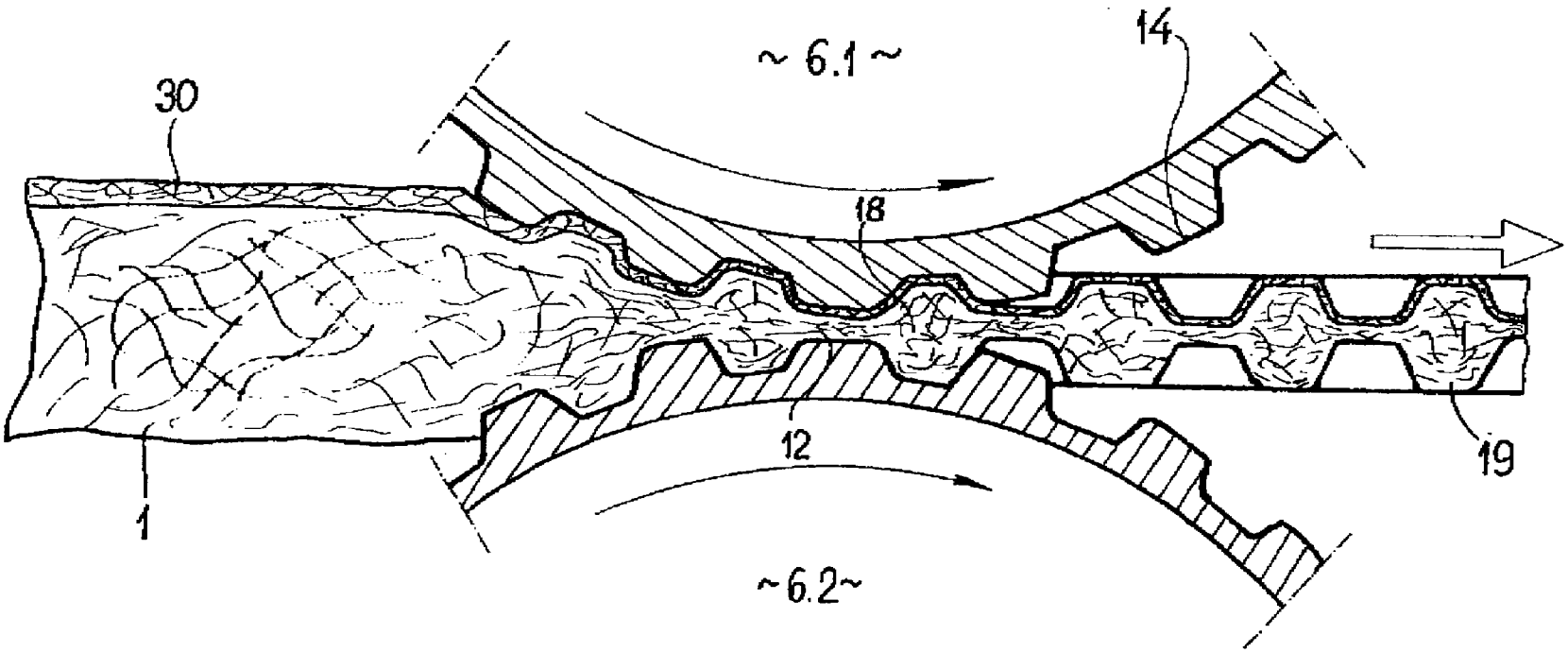
FIG. 7 is a representation similar to FIG. 2 of a cross-section of the pressure zone of two rollers with an inserted fiber web with a foil placed on it.

FIG. 7 shows an exemplary embodiment of a high pressure zone between the two calender rollers 6.1 and 6.2. As can be seen, the outer roller surface is provided with studs 14 shown in an enlarged presentation. The numerous studs 14 distributed across the entire outer roller surface preferably result in an array density of the point-shaped pressure regions of between 1 and 16 array points per cm$^2$ for the finished fiber web. The studs have the shape of a truncated pyramid with a stud coat angle of 10 to 45° in relation to the radius. A calculated pressure of a bout 520 MPa, which leads to the aforementioned fusion of the cellulose fibers in the gap, is present in the gap 12, where the pressure zone 17 is created. Other shapes of the pressure zones, such as truncated cones, cylinders or cubes are possible and are selected according to professional opinions according to the required pressure, the respective starting material and the material of the rollers, the temperatures that occur, etc. Foil 30 can be calendered or laminated at the same time.

For FIG. 7, the direction of the operation is from left to right. Thus, the finished product exhibits almost lucid fusion zones 18, that alternate with somewhat fluffy loose regions 19 that are, however, compressed when compared to the starting non-woven.

The coating methods are described in greater detail based on the following examples:

EXAMPLE 1

A fiber web 100 (cf. FIG. 3) is combined on one side with a web of woven textile material. On the surface pointing to the fiber web, the textile web is provided with a Hotmelt adhesive, such that a good adhesive bond is produced after passing through the pressure rolls 9.1, 9.2. Because of the fiber material, such a composite exhibits good heat insulating effects and can withstand greater mechanical forces due to the woven textile web.

EXAMPLE 2

The fiber web 100 produced according to the description of FIGS. 1 to 3 is at its uncoated surface additionally bonded to a foil-type, semi-permeable climatic membrane made of polytetrafluorethylen using an adhesive. The climatic membrane is water resistant but permeable to water steam. When used as liner material for hygiene garments, the water vapor emitted by the user can be taken up by the fiber fabric and then dissipated by the climatic membrane. At the same time, the fiber layer is protected from moisture.

EXAMPLE 3

A non-woven web 100 is combined with a polytetrafluorethylen foil with a thickness of 20 $\mu$m, which is coated on one side with an adhesive free of solvents. The calender rolls 6.1, 6.2 create a composite. At its uncoated side, an additional polyethylene foil is placed on the composite before it enters the calender rollers 9.1, 9.2. The needle rollers (not shown) apply a perforation to the second polyethylene foil. The foil particles infiltrating the fiber web during the perforation procedure cause a mechanical anchoring between the fiber web with a first foil glued to it and the second foil. The result is a material 200 that is absorbent towards one surface and tight to liquid towards the other surface, which is particularly suited for use in hygiene products.

In recycling, the soiled fiber web can be composted after tearing off the top foil coatings. The composite material subject to the invention is more environmentally friendly than, for example, the cellulose with polymeric superabsorbers used for disposable diapers.

There has thus been shown and described a novel method and device for producing a fiber web consisting of cellulose fibers which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for producing an absorbent fiber web which is tear resistant, and rollable, from cellulose fibers, cellulose pulp or of wood pulp cardboard without the use of additional binding agents, where said fiber web is suitable for use in the hygiene sector comprising the following processing steps:

(a) providing an irregular cellulose fiber layer and precondensing it under relatively low pressure to produce a loose non-woven with low density and tear strength; and (b) providing a pair of calender rolls having a pattern of point or line-shaped sluds, defining a gap therebetween, and inserting the loose non-woven into the gap of the calender rolls that is used to create a pattern of point- or line-shaped pressure zones under relatively high pressure, where the irregularly arranged fibers are pressed onto each other, wherein (1) the loose non-woven has a moisture content of up to 5 percent by weight when it is inserted, (2) the irregularly arranged fibers are pressed onto each other under a pressure in a range between 250 and 600 MPa such that non-separating fusion of the fibers occurs and a fiber web with an embossing pattern is created, and (3) the tear strength of the fiber web is at least 0.12 kN/m.

2. Method as set forth in claim 1, wherein a fiber web is produced with a $m^2$/weight between 50 g and 500 g.

3. Method as set forth in claim 1, wherein a fiber web is produced with an array density of the point-shaped pressure zones between 1 and 16 per $cm^2$.

4. Method as set forth in claim 1, wherein the point-shaped pressure zones have an area of between 0.05 and 10 $mm^2$.

5. Method as set forth in claim 1, wherein the temperature of the calender rolls is maintained at approximately room temperature, that is, between 18 and 26° C.

6. Method as set forth in claim 1, wherein pre-compression occurs at a temperature of 18 to 320° C.

7. Method as set forth in claim 1, wherein a second pair of calender rolls is used as pre-compressing tool.

8. Method as set forth in claim 1, wherein the fiber layer provided in step (a) is a mixture of fiber material and superabsorber, and where the superabsorber content is between 0.5 and 70 percent by weight of the mixture.

9. Method as set forth in claim 1, wherein the cellulose fibers used as starting material have a degree of whiteness of 80 to 90%.

10. Method as set forth in claim 1, wherein cellulose fibers with a residual content of lignin of 0.5 to 5 percent by weight are used as starting material.

11. Method as set forth in claim 1, wherein the irregular cellulose fiber web of step (a) contains supplementary filler materials.

12. A method for producing an absorbent fiber web which is tear resistant, and rollable, from cellulose fibers, cellulose pulp or of wood pulp carboard without the use of additional binding agents, where said fiber web is suitable for use in the hygiene sector comprising the following processing steps:

(a) providing an irregular cellulose fiber layer and precondensing it under relatively low pressure to produce a loose non-woven with low density and tear strength; and (b) providing a pair of calender rolls having a pattern of point or line-shaped studs, defining a gap therebetween said calender rolls having a radial distance, beyond the actual point-shaped pressure zone of 1 to 5 mm in the pressure zone; and inserting the loose non-woven into the gap of the calender rolls that is used to create a pattern of point- or line-shaped pressure zones under relatively high pressure, where the irregularly arranged fibers are pressed onto each other, wherein (1) the loose non-woven has a moisture content of up to 5 percent by weight when it is inserted, (2) the irregularly arranged fibers are pressed onto each other under a pressure in a range between 250 and 600 MPa such that a non-separating fusion of the fibers occurs and a fiber web with an embossing pattern is created, and (3) the tear strength of the fiber web is at least 0.12 kN/m.

13. Method as set forth in claim 1, wherein the gap in the pressure zone of the calender rolls, between opposing point-shaped pressure zones, exhibits a clear width of 0.05 to 1 mm.

14. A device for producing an absorbent fiber web which is tear resistant, and rollable, from cellulose fibers, cellulose pulp or of wood pulp carboard without the use of additional binding agents, where said fiber web is suitable for use in the hygiene sector, said device comprising;

(a) a pair of calender rolls having a pattern of point or line-shaped studs, defining an operational gap therebetween, and (b) means for providing an irregular cellulose fiber layer and pre-condensing it under relatively low pressure; and means for providing the loose non-woven has a moisture content of up to 5 percent by weight before it is inserted into the operational gap, wherein the pair of calender rolls consist of two calender rolls that are both provided with numerous studs distributed across the outer surface of the rollers and surrounded by indentations that exhibit a multiple of the volume of the studs wherein the studs are opposite one another in the operational gap and where a pressure of at least 200 MPa up to the maximum liquid salt limit of the material used for the studs can be applied in point-shaped pressure zones to the loose non-woven, which is located between the studs, to create a pattern of point- or line-shaped pressure zones where the irregularly arranged fibers are pressed onto each other, such that a non-separating fusion of the fibers occurs and a fiber web with an embossing pattern is created, having a tear strength of at least 0.12 kN/m.

15. Device as set forth in claim 14, wherein the height of the studs form the roller base is between 0.5 and 5 mm.

16. Device as set forth in claim 14, wherein the studs have the shape of truncated pyramids.

17. Device as set forth in claim 16, wherein the truncated zone shapes or pyramid shapes have a stud coat angle between 10 and 45° in relation to the radius.

18. An absorbent fiber matt which is tear resistant, and rollable, from cellulose fibers, cellulose pulp or of wood pulp carboard without the use of additional binding agents, and has a tear strength of the fiber web is at least 0.12 kN/m, which is suitable for use in hygiene products, made by the following processing steps:

(a) providing an irregular cellulose fiber layer and pre-condensing it under relatively low pressure to produce a loose non-woven with low density and tear strength; and (b) providing a pair of calender rolls having a pattern of point or line-shaped studs, defining a gap therebetween, and inserting the loose non-woven into the gap of the calender rolls that is used to create a pattern of point- or line-shaped pressure zones under relatively high pressure, where the irregularly arranged fibers are pressed onto each other, wherein (1) the loose non-woven has a moisture content of up to 5 percent by weight when it is inserted into the gap, (2) the irregularly arranged fibers are pressed onto each other under a pressure in a range between 250 and 600 MPa;

such that a non-separating fusion of the fibers occurs creating a fiber web with an embossing pattern.

19. Method as set forth in claim 1, wherein the fiber web provided in step (a) is a mixture of fiber material and superabsorbent, and where the superabsorbent content is between 5 and 30 percent by weight of the mixture.

20. Method as set forth in claim 1, wherein the cellulose fibers used as starting material have a degree of whiteness of 85 to 89%.

21. Method as set forth in claim 1, wherein a starting material is used that contains supplementary filler materials selected from the group of filler materials consisting of titanium oxide, chalk and kaolin.

22. Method as set forth in claim 1, wherein a starting material is used that contains supplementary filler materials selected from the group of filler materials consisting of titanium oxide, chalk and kaolin.

23. Device as set forth in claim 14, wherein the angle of the stud coat in relation to the radius is between 10 and 45.

24. Device as set forth in claim 14, wherein the studs have the shape of cubes.

* * * * *